US008746844B2

(12) United States Patent
Kusakari et al.

(10) Patent No.: US 8,746,844 B2
(45) Date of Patent: Jun. 10, 2014

(54) NOZZLE LAYOUT FOR FLUID DROPLET EJECTING

(75) Inventors: Tsutomu Kusakari, Cupertino, CA (US); Kevin von Essen, San Jose, CA (US); Paul A. Hoisington, Hanover, NH (US)

(73) Assignee: FUJIFILM Corporation, Tokyo (JP)

( * ) Notice: Subject to any disclaimer, the term of this patent is extended or adjusted under 35 U.S.C. 154(b) by 14 days.

(21) Appl. No.: 13/410,519

(22) Filed: Mar. 2, 2012

(65) Prior Publication Data

US 2012/0162316 A1 Jun. 28, 2012

Related U.S. Application Data

(63) Continuation of application No. 12/992,254, filed as application No. PCT/US2009/042526 on May 1, 2009.

(60) Provisional application No. 61/055,936, filed on May 23, 2008.

(51) Int. Cl.
*B41J 2/155* (2006.01)

(52) U.S. Cl.
USPC ..... 347/42

(58) Field of Classification Search
USPC ..... 347/42
See application file for complete search history.

(56) References Cited

U.S. PATENT DOCUMENTS

| | | | |
|---|---|---|---|
| 6,048,052 | A | 4/2000 | Kitahara et al. |
| 6,328,418 | B1 | 12/2001 | Yamada et al. |
| 6,345,879 | B1 | 2/2002 | Fisher |
| 6,471,317 | B2 | 10/2002 | Chang |
| 6,575,558 | B1 | 6/2003 | Grose et al. |
| 6,592,204 | B1 | 7/2003 | Beliveau et al. |
| 6,669,330 | B2 | 12/2003 | Vanhooydonck et al. |
| 7,192,118 | B2 | 3/2007 | Kojima et al. |
| 2005/0001868 | A1 | 1/2005 | Matsuba et al. |
| 2005/0001877 | A1 | 1/2005 | Chikanawa et al. |
| 2005/0001881 | A1 | 1/2005 | Nakashima et al. |

(Continued)

FOREIGN PATENT DOCUMENTS

| | | |
|---|---|---|
| JP | 06171084 | 6/1994 |

(Continued)

OTHER PUBLICATIONS

Notification of Reasons for Rejection issued Jul. 20, 2012 in Japanese Patent Application No. 2011-510548, 11 pgs.
International Search Report and Written Opinion dated Jun. 22, 2009 issued in international application No. PCT/US2009/042526, 11 pgs.
International Preliminary Report on Patentability dated Dec. 2, 2010 issued in international application No. PCT/US2009/042526, 10 pgs.

*Primary Examiner* — Julian Huffman
(74) *Attorney, Agent, or Firm* — Fish & Richardson P.C.

(57) ABSTRACT

A fluid ejection apparatus includes a printhead having a substrate. The substrate includes a nozzle face having a width direction and a length direction. The nozzle face includes a set of four columns of nozzles oriented in a column direction substantially along the width direction of the nozzle face, and the nozzles in each column are positioned on a straight line along the column. A spacing between two adjacent columns of the four adjacent columns is different than a spacing between another two adjacent columns of the four adjacent columns. In some implementations, a controller can control timing of ejection of fluid droplets from the nozzles to deposit lines of fluid droplets on a medium, and the medium can travel relative to the nozzle face.

4 Claims, 10 Drawing Sheets

(56) References Cited

U.S. PATENT DOCUMENTS

| | | | | |
|---|---|---|---|---|
| 2005/0212872 | A1* | 9/2005 | Yamanobe | 347/78 |
| 2005/0285896 | A1* | 12/2005 | Hori | 347/40 |
| 2006/0221125 | A1 | 10/2006 | Konno | |
| 2007/0132815 | A1 | 6/2007 | Sakaida | |

FOREIGN PATENT DOCUMENTS

| | | |
|---|---|---|
| JP | 2004345348 | 9/2004 |
| JP | 2006264268 | 5/2006 |
| JP | 2007090520 | 4/2007 |
| WO | 2009142894 | 11/2009 |

* cited by examiner

NOZZLE LAYOUT FOR FLUID DROPLET EJECTING

CROSS-REFERENCE TO RELATED APPLICATIONS

This application is a continuation and claims the benefit of priority under 35 USC 120 of U.S. application Ser. No. 12/992,254, filed Mar. 3, 2011, which is a national stage application of International Application Number PCT/US2009/042526, filed on May 1, 2009, which is based on and claims the benefit of the filing date of U.S. Provisional Application No. 61/055,936, filed on May 23, 2008, all of which as filed are incorporated herein by reference in their entireties.

BACKGROUND

This description relates to fluid droplet ejection. In some implementations of a fluid droplet ejection device, a substrate, such as a silicon substrate, includes a fluid pumping chamber, a descender, and a nozzle formed therein. Fluid droplets can be ejected from the nozzle and deposited onto a medium, such as in a printing operation. The nozzle is fluidly connected to the descender, which is fluidly connected to the fluid pumping chamber. The fluid pumping chamber can be actuated by a thermal or piezoelectric transducer, and when actuated, the fluid pumping chamber can cause ejection of a fluid droplet through the nozzle. The medium can be moved relative to the fluid droplet ejection device. The ejection of a fluid droplet from a nozzle can be timed with the travel of the medium to place a fluid droplet at a desired location on the medium. These fluid droplet ejection devices typically include multiple nozzles and a high density of nozzles.

SUMMARY

In one aspect, systems, apparatus, and methods for fluid ejecting include a nozzle face having a width direction and a length direction. The nozzle face can include a set of three adjacent columns of nozzles oriented in a column direction substantially along the width direction of the nozzle face. The column direction can be oblique to both the width direction and the length direction. The nozzles in each column can be positioned on a straight line along the column. A spacing between two adjacent columns of the set of three adjacent columns can be different than a spacing between another two adjacent columns of the set of three adjacent columns.

In another aspect, an apparatus for depositing fluid droplets on a medium includes a nozzle face having a width direction along a width of the nozzle face, a length direction along a length of the nozzle face, and a plurality of nozzles configured for ejecting fluid droplets. The nozzles can be arranged in substantially parallel columns, and the nozzles in each column can be positioned on a straight line along the column. The columns can be oriented in a column direction extending substantially across the width of the nozzle face. The column direction can be oblique to the width of the nozzle face. The columns can be spaced relative to each other in a column spacing pattern such that adjacent droplets deposited on a droplet line are deposited by nozzles of a different column. A spacing in the length direction between columns in a pair of adjacent columns can be not equal for all pairs of two adjacent columns. Each column can be offset in the width direction of the nozzle face relative to an adjacent column.

In another aspect, an apparatus for depositing fluid droplets on a medium can include a print frame having a length direction along a long edge and a width direction along a short edge. A printhead can be secured to the print frame. A nozzle layer can be secured to the printhead. The nozzle layer can have a nozzle face, and the nozzle face can have a length and a width. Three adjacent columns of nozzles can be oriented in a column direction substantially along a width of the nozzle face and at an oblique angle relative to both the length direction and the width direction of the print frame. The nozzles in each column can be arranged on a straight line along each column. A spacing between two adjacent columns of the three adjacent columns can be different than a spacing between another two adjacent columns of the three adjacent columns.

In another aspect, a fluid ejection apparatus can include a frame having a length direction along a long edge and a width direction along a short edge. A printhead can be secured to the print frame. A nozzle layer can be secured to the printhead. The nozzle layer can have a nozzle face, and the nozzle face can have a length and a width. Three adjacent columns of nozzles can be oriented in a column direction substantially along a width of the nozzle face and at an oblique angle relative to both the length direction and the width direction of the print frame. The nozzles in each column can be arranged on a straight line along the column. The nozzles in each column can be arranged on rows in a row direction, the row direction being substantially along a length of the nozzle face and at an oblique angle relative to both the length direction and the width direction of the print frame.

In another aspect, a fluid ejection apparatus can include a nozzle face having a width direction along a short edge of the nozzle face and a length direction along a long edge of the nozzle face. A plurality of nozzles can be configured for ejecting fluid droplets, the nozzles being arranged in substantially parallel columns. The nozzles in each column can be positioned on a straight light along each column. The columns can be oriented in a column direction extending substantially along the width direction. The columns can be divided into at least three contiguous bands along the column direction. The three bands can include a first band proximate to the long edge of the nozzle face, a second band adjacent to the first band, and a third band adjacent to the second band. A first nozzle can be in the first band and configured to deposit a first droplet at a first position, as considered in the length direction. A second nozzle can be in the second band and configured to deposit a second droplet at a second position, as considered in the length direction. A third nozzle can be in the third band and configured to deposit a third droplet at a third position between the first position and the second position, as considered in the length direction.

Implementations can include one or more of the following features. A spacing between each column and a next adjacent column can be different for each column in a set of three adjacent columns. In some implementations, a spacing between a first column and a second column in a set of four adjacent columns can be equal to a spacing between a third column and a fourth column in the set of four adjacent columns, and a spacing between a second column and a third column in the set of four adjacent columns can be equal to a spacing between a fourth column in the set of four adjacent columns and a first column in a next adjacent set of four adjacent columns.

An apparatus can further include a controller configured to control a timing of ejection of fluid droplets through the nozzles while the nozzle face and the medium undergo relative motion in a medium travel direction. The columns can be divided into four bands along the column direction. The controller can control the timing of ejection of fluid droplets such that for a row of four directly adjacent droplets deposited on a medium, a single nozzle from each of the four bands deposits one of the four directly adjacent droplets. A distance between adjacent droplets can be a droplet pitch. The four bands can include a first band proximate to a first long edge of the nozzle face, a second band adjacent to the first band, a third band adjacent to the second band, and a fourth band adjacent to the third band. The four directly adjacent droplets, considered sequentially along the length direction of the nozzle face, can be deposited by a nozzle in the first band, second band, fourth band, and third band, respectively. Alternatively, the four directly adjacent droplets, considered sequentially along the length direction of the nozzle face, can be deposited by a nozzle in the first band, third band, second band, and fourth band, respectively. In some implementations, each nozzle face can include 64 columns, and each column can include 32 nozzles. Also, in some implementations, adjacent nozzles in each column can be separated by a distance of about 14 droplet pitches in the width direction. The droplet pitch can be about one twelve-hundredth of an inch in some implementations.

A column spacing pattern can repeat every fifth column, such that columns can be grouped into sets of four columns. The column spacing pattern can include a first spacing between a first column and a second column of a first set of four columns, a second spacing between a second column and a third column of the first set of four columns, a third spacing between a third column and a fourth column of the first set of four columns, and a fourth spacing between a fourth column of the first set of four columns and an adjacent first column of a second set of four columns. In some implementations, the first spacing and the fourth spacing can be substantially equal, and the second spacing and the third spacing can be substantially equal. In some other implementations, none of the first, second, third, or fourth spacing are equal to another of the first, second, third, or fourth spacing. In some implementations, each column in a set of four columns can include a same number of nozzles. The number of nozzles in each column multiplied by a droplet pitch can be x, and the first spacing can be about x+1, the second spacing can be about x+2, the third spacing can be about x−1, and the fourth spacing can be about x−2. The nozzles in each column can be equally spaced. Each column along the length of the nozzle face can be offset in the width direction of the nozzle face by a distance of about one droplet pitch relative to a preceding adjacent column. In some implementations, the first spacing can be about 33 droplet pitches, the second spacing can be about 34 droplet pitches, the third spacing can be about 31 droplet pitches, and the fourth spacing can be about 30 droplet pitches.

The spacing between each column and a next adjacent column can be different for each column in a set of four adjacent columns. An apparatus can include a controller configured to control a timing of ejection of fluid droplets through nozzles while a print frame and a medium undergo relative motion in a medium travel direction.

In some embodiments, the apparatus may include one or more of the following advantages. A nozzle layout with unequal spacing between columns of nozzles can be configured with all of the nozzles in a column being positioned on a straight line along the column rather than staggered along the column. This arrangement of nozzles on a straight line can permit use of a straight passage for supplying fluid to the nozzles, which can reduce a width of the columns and simplify manufacturing. Each column can be separated into bands. The use of bands can also reduce a distance, in a medium travel direction, between nozzles that deposit adjacent droplets on the medium. This reduction in distance can reduce inaccuracies in fluid droplet deposition that cause aberrations such as streaks. Inaccuracies can be caused by movement of the medium in a sideways direction, such as web weave, during a printing operation.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Fluid droplet ejection can be implemented with a printhead mounted in a print frame. The printhead includes a substrate, such as a silicon substrate. The substrate includes a flow path body, a nozzle layer, and a membrane. The flow path body includes one or more fluid flow paths formed therein, and each flow path can include a fluid pumping chamber, a descender, and a nozzle. The nozzle layer has a nozzle face on a surface of the nozzle layer opposite the flow path body. Nozzles are arranged on the nozzle face in a nozzle layout and are configured to deposit droplets of fluid onto a medium, such as a sheet of paper. The medium can be moving relative to the printhead, such as during a printing operation.

The nozzle layout includes columns of nozzles, and the nozzles can be arranged in the columns on a straight line. In some implementations, all of the nozzles in a column can be arranged on a straight line along the column. Adjacent droplets in a row of droplets on the medium can be deposited by nozzles of the same column or different columns. In some implementations, each column can be divided into bands, such that the nozzle face includes multiple bands of nozzles. For example, if the nozzle face has four bands of nozzles, then in a row of four adjacent droplets on the medium, each droplet can be deposited by a nozzle from a different band. The bands can be defined by rows of nozzles. Spacing between columns can be unequal to facilitate the nozzle layout or for other purposes. The fluid can be, for example, a chemical compound, a biological substance, or ink.

Figure 1A:
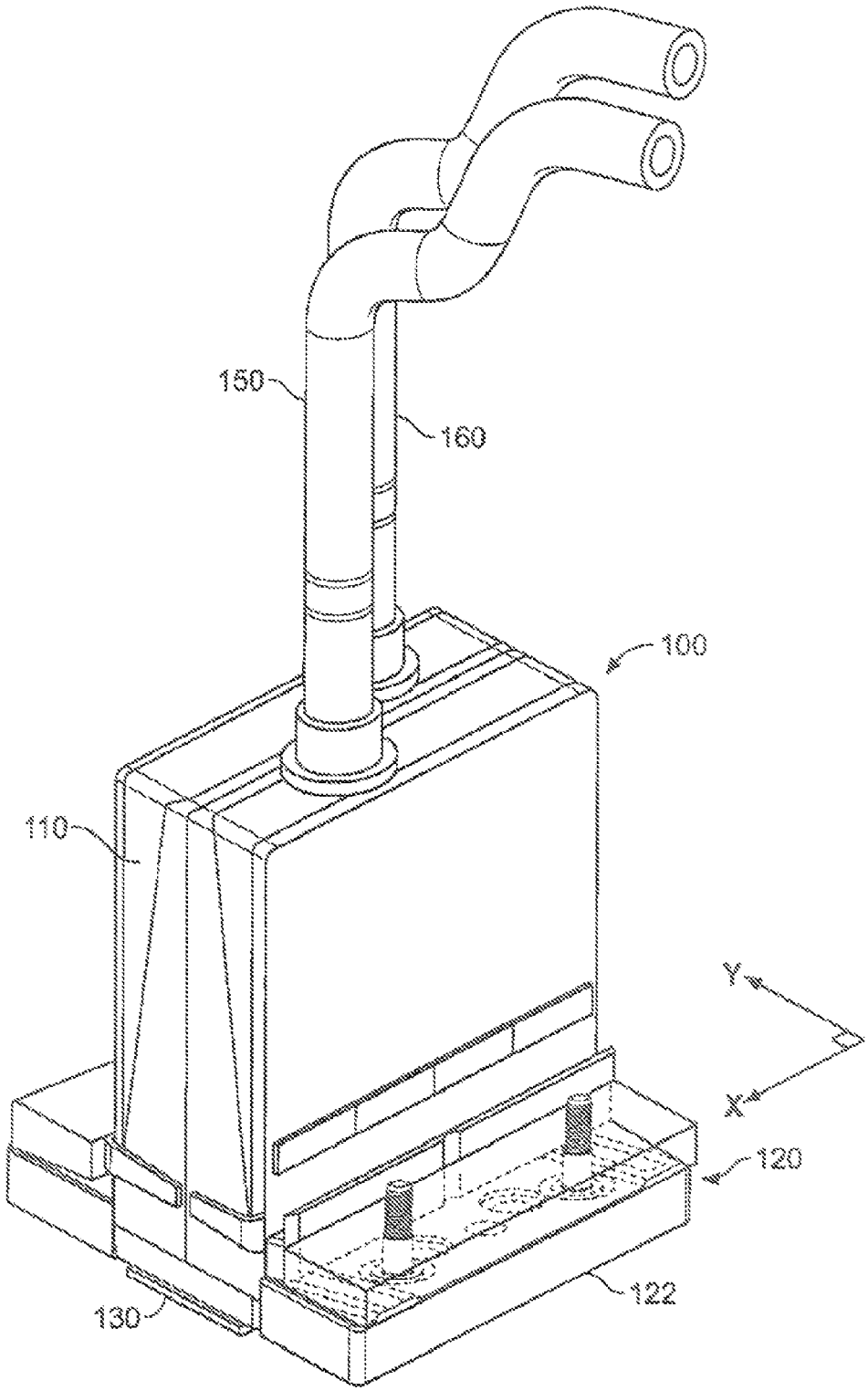
FIG. 1A is a perspective view of an example fluid ejection structure.

FIG. 1A shows an implementation of a printhead 100 for fluid droplet ejection. The printhead 100 includes a casing 110. A mounting assembly 120 is attached to the casing 110 and includes a mounting component 122. The printhead 100 also includes a substrate 130 attached to the bottom of the casing 110. The substrate 130 can be composed of silicon, such as single crystal silicon. The substrate can include a flow path body 605 (see FIG. 6B) with a microfabricated fluid path formed therein. A supply tube 150 and a return tube 160 can be configured to fluidly connect the printhead 100 with a supply tank (not shown) and a return tank (not shown), respectively. A length and a width of the printhead 100 are oriented substantially along an x direction and a y direction, respectively, as discussed below.

Figure 1B:
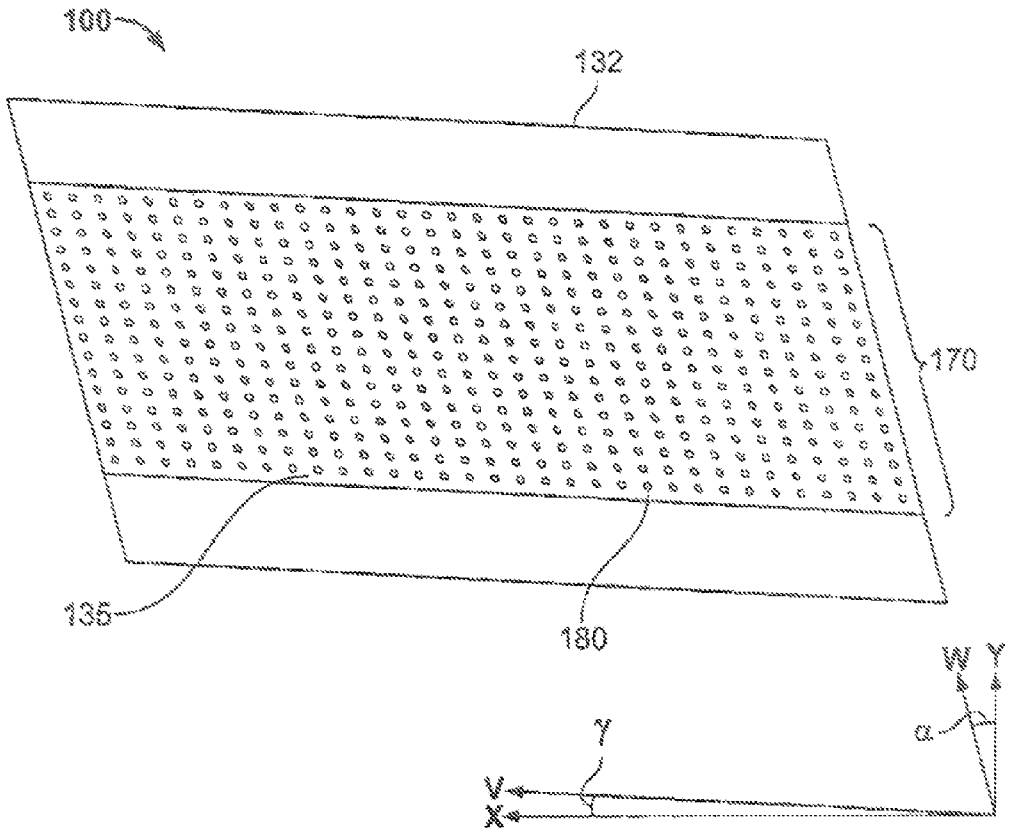
FIG. 1B is a bottom plan view of a portion of the structure of FIG. 1A.

FIG. 1B shows a bottom surface of the substrate 130. The substrate 130 includes a nozzle layer 132, and the nozzle layer 132 has a nozzle face 135. The nozzle face 135 includes multiple columns 170 of nozzles 180. The number of nozzles 180 on the nozzle face 135 has been reduced, and the nozzles are shown enlarged, for illustrative purposes in FIG. 1B. The nozzle face 135 has a quadrilateral shape. The nozzle face 135 has long edges oriented in a v direction that is at an angle $\gamma$ relative to the x direction. The nozzle face 135 has short edges oriented in a w direction that is at an angle $\alpha$ relative to the y direction. The columns 170 extend in the w direction. In alternative implementations, the w direction can be at some other oblique angle relative to the width of the substrate 130, the y direction, or both. The nozzle face 135 can be formed as a surface of a separate nozzle layer 132. Alternatively, the nozzle face 135 and the nozzle layer 132 can be formed as a unitary part of the substrate 130. The substrate 130 can also include a membrane 675 (see FIG. 6B). The membrane 675 can be formed on a surface of the flow path body 605 opposite the nozzle layer 632 (see FIG. 6B).

Figure 1C:
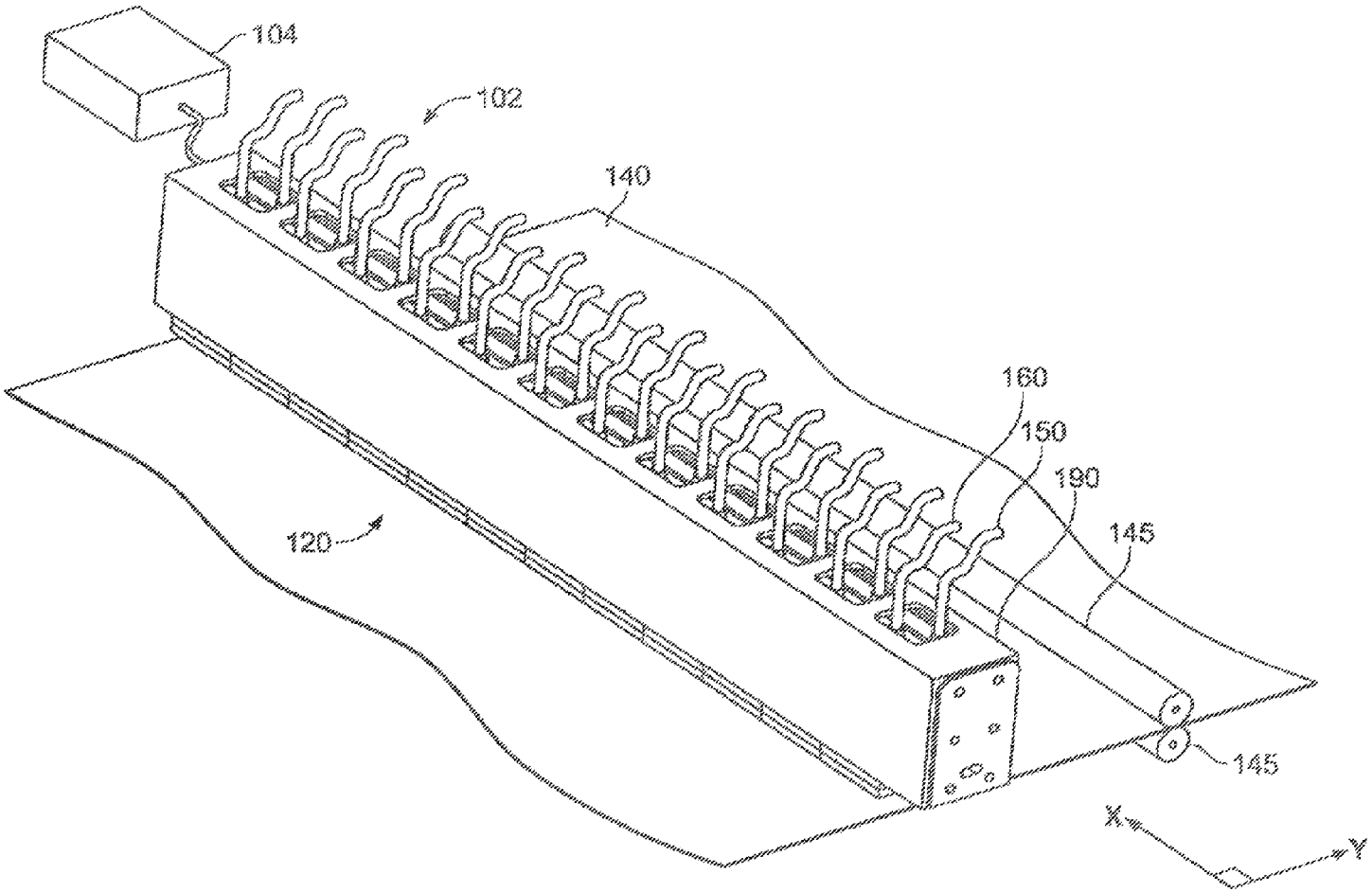
FIG. 1C is a perspective view of an example fluid ejection apparatus.

FIG. 1C shows an implementation of multiple printheads 100 mounted in a print frame 190 to form a fluid ejection system 102. A controller 104 can be electrically connected to the fluid ejection system 102 to control fluid droplet ejection, as discussed in more detail below. A long edge of the print frame 190 corresponds to a length direction of the print frame 190 and is oriented in the x direction. A short edge of the print frame 190 is oriented in the y direction, perpendicular to the x direction, and corresponds to a width direction of the print frame 190. The medium shown in FIG. 1C is a sheet 140, and the sheet 140 can be composed of, for example, paper or some other material suitable for printing. The sheet 140 can be positioned beneath the print frame 190, and fluid droplets ejected from the nozzles 180 can be deposited on the medium. The medium and the print frame 190 can be moving relative to one another in the y direction during a printing operation. This relative motion can be effected by rollers 145 in contact with the sheet 140. In alternative implementations, movement of the sheet 140 can be effected by a lesser or greater number of rollers 145, by pneumatic pressure, by momentum of the sheet 140, or some other suitable mechanism. In some implementations, the print frame 190 can span a full width (in the x direction) of the sheet 140.

Figure 1D:
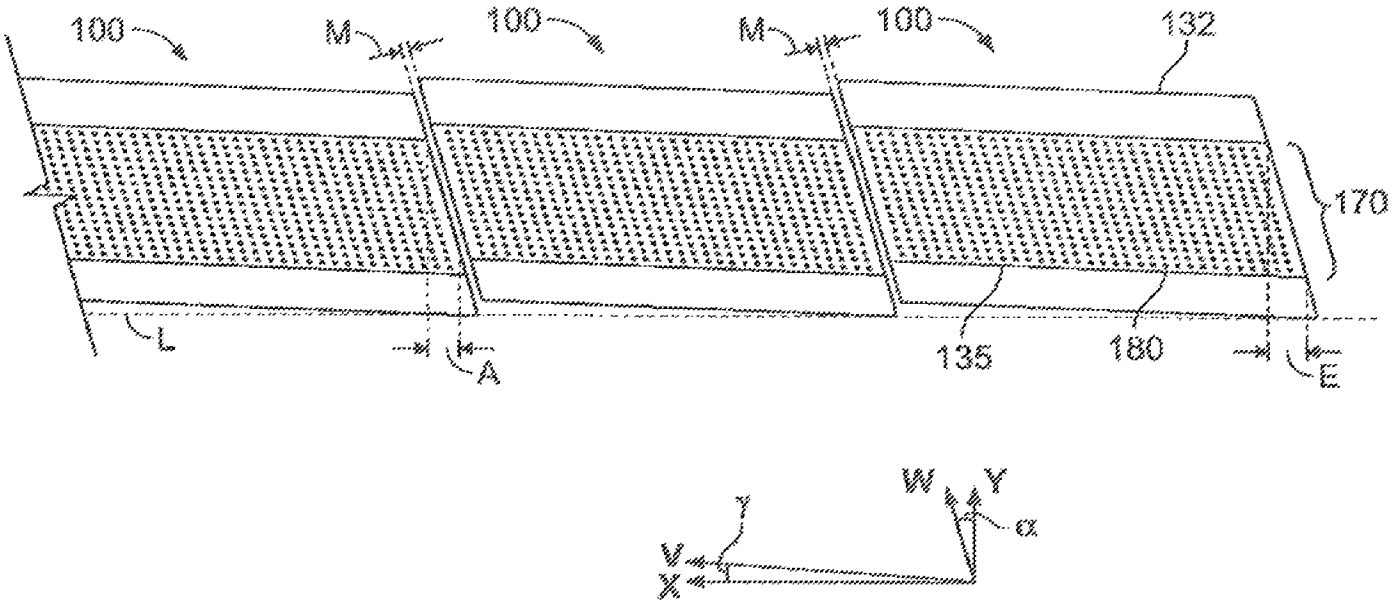
FIG. 1D is a bottom plan view of a portion of the apparatus of FIG. 1C.

FIG. 1D shows a bottom plan view of the multiple printheads 100 of FIG. 1C, including the bottom of the substrates 130, shown without the print frame 190 for illustrative purposes. The printheads 100 are arranged substantially along a line L that is parallel with the x direction. A pitch of the printheads 100 (i.e. a spacing of the printheads 100) can be equal to the number of nozzles 180 on each printhead divided by an average distance between adjacent nozzles 180 in the x direction. The printheads can be separated by a printhead gap M, which is exaggerated in FIG. 1D for illustrative purposes. The gap M can be, for example, between about 5.0 microns and about 200 microns, such as about 50 microns. The printhead gap M can vary between different pairs of printheads. In this implementation, the w direction is at an oblique angle relative to the width of the print frame.

In this implementation, because the short edges of the printheads 100 are oriented in the w direction, the substrates 130 have an overlap A in the x direction. This overlap A can permit continuity of fluid droplet deposition along the x direction between substrates 130. The necessary size of the overlap A to achieve continuity of fluid droplet deposit can depend, for example, on a minimum manufacturable distance between a short edge of a substrate 130 and a column 170 of nozzles 180. The overlap A can also be determined in part by the angle $\alpha$. Configuring the long edges of the printheads 100 and the substrates 130 in the v direction in this implementation can eliminate or reduce the need for an offset or staggered configuration of multiple rows of printheads 100 to achieve the overlap A. Within the overlap A, adjacent droplets on the medium may be deposited by nozzles 180 on different nozzle faces 135.

FIG. 1D also shows an edge portion E of the rightmost printhead 100. Because the nozzles 180 are arranged in columns 170 that are at an angle relative to the y direction, complete overlap of nozzles 180 may be lacking in the edge portion E. Therefore, full droplet resolution may not be achieved in the edge portion E. In some implementations, the nozzles 180 in the edge portion E may therefore be unused.

Figure 2A:
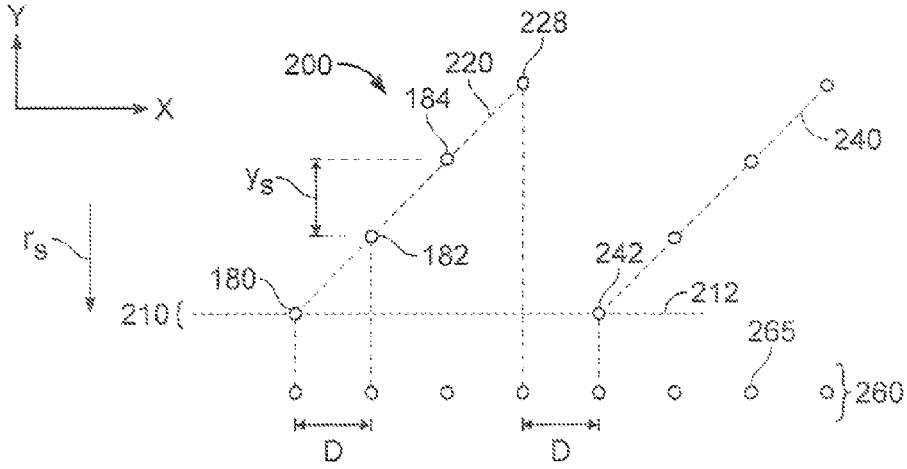
FIG. 2A (Prior Art)
FIGS. 2A and 2B are schematic representations of nozzle layouts.

FIG. 2A is a schematic representation of a prior art nozzle layout 200 with nozzles 180 arranged in a first column 220 and a second column 240. The columns 220, 240 are parallel to one another. The nozzles 180 are also arranged in rows, such as row 210. All of the nozzles 180 in row 210 can be positioned along a line 212. A row 260 represents a portion of a row 260 of droplets 265 deposited on a medium positioned beneath the nozzle layout 200. In this implementation, the medium travels in the y direction relative to the nozzle layout 200. The y direction can also be referred to as a medium travel direction. The columns 220, 240 are configured side-by-side in the x direction such that the leftmost nozzle 242 of the second column 240 is positioned at a distance D (in the x direction) to right of the rightmost nozzle 228 in the first column 220. Droplets 265 in the row 260 are separated by the distance D, which can be referred to as a droplet spacing or a droplet pitch. Although some of the nozzles 180 are offset in the y direction with respect to one another, the timing of ejection of the nozzles 180 can be controlled such that the nozzles 180 deposit droplets in a common position in the y direction as the medium travels relative to the printhead 100 in the y direction. Multiple rows 260 of droplets 265 can be deposited on the medium in a similar fashion.

Except at the edges where adjacent substrates 130 can overlap (as shown in FIG. 1D), droplets 265 in the row 260 can be uniformly spaced by the distance D. Thus, an x-direction of the substrate 130 itself can also be defined as the axis along which, when the nozzles are projected onto the axis, the nozzles are uniformly spaced (excepting the edges).

This timing can be controlled by a controller 104 (FIG. 1C) configured to control the timing of fluid droplet ejection from each nozzle 180. In this implementation, each nozzle 180 can be driven by an independently actuatable transducer 680 (see FIG. 6B) in pressure communication with a fluid pumping chamber 640 (see FIG. 6B) that is in fluid communication with the nozzle 180. Actuation of the transducer 680 can cause ejection of a fluid droplet to provide drop-on-demand ejection. Each transducer 680 can be connected to the controller 104 by circuitry (not shown). The timing of fluid droplet ejection can be controlled to deposit droplets 265 in a row 260 or multiple rows 260 on the medium. As the medium moves in the y direction relative to the nozzles 180, the timing of ejection from each nozzle 180 can be delayed or advanced relative to other nozzles 180 in adjacent rows or columns. This delay or advance can account for differences in position of the nozzles 180 in the y direction. For example, where the medium travels at a rate, $r_s$, and the distance between nozzles 182, 184 in the y direction is $y_s$, the medium travels the distance $y_s$ in a time, t, equal to the distance $y_s$ divided by the rate $r_s$. The controller 104 can be configured to delay or advance, as appropriate, the timing of fluid droplet ejection from one or both of the nozzles 182, 184 by amounts of time totaling the time t so that the nozzles 182, 184 deposit droplets 265 in a same position in the y direction. The controller 104 can be configured to effect a similar delay or advance, as appropriate, for some or all of the nozzles 180 in the nozzle layout 200. Further, the controller 104 can effect these delays and advances for multiple rows 260 of droplets 265 as the medium travels relative to the nozzle layout 200.

FIG. 2A is representative of a "single-banded" nozzle layout 200. Adjacent droplets in the row 260, considered from left to right, are deposited by nozzles 180 of the first column 220 until the end of the first column 220 is reached. Subsequent droplets in the row 260 are then similarly deposited by nozzles 180 of the second column 240 until the end of the second column 240 is reached.

Figure 2B:
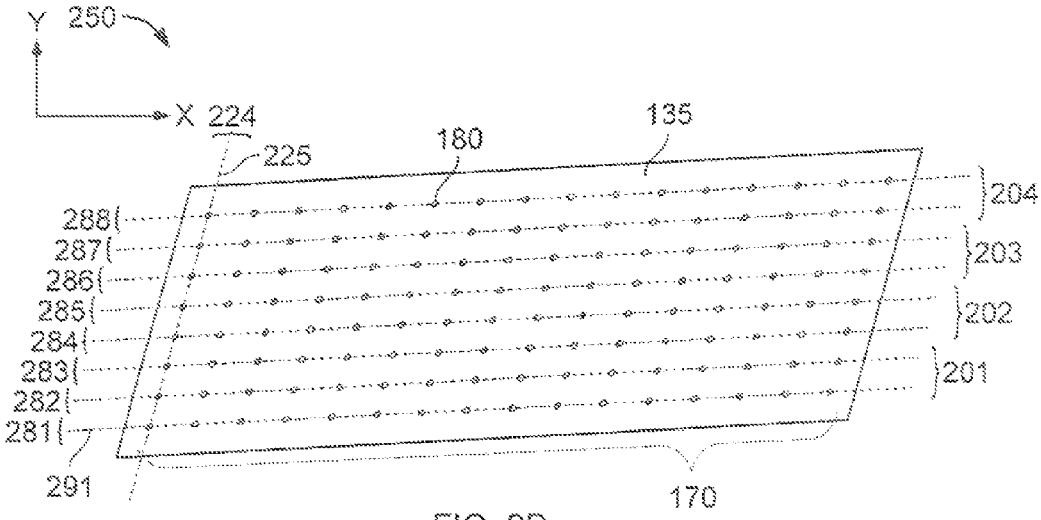

FIG. 2B is a schematic representation of a nozzle layout 250. The nozzles 180 are arranged on the nozzle face 135 in columns, such as column 224. The bottommost nozzles 180 of the columns form a first row 281. Subsequent nozzles 180 in each of the columns form a second row 282, a third row 283, a fourth row 284, a fifth row 285, a sixth row 286, a seventh row 287, and an eighth row 288. In some implementations, the nozzles 180 of the rows are positioned along, e.g., on, straight lines. For example, all of the nozzles of row 281 can be positioned on a straight line 291. In other implementations, the nozzles 180 can be staggered along straight lines or arranged in some other configuration. Similarly, the nozzles 180 of the columns can be positioned along, e.g., on, a straight line. For example, all of the nozzles of column 224 can be positioned on a straight line 225. The nozzle layout 250 is shown with 16 columns 170, each with 8 nozzles 180, for illustrative purposes. A different number of columns 170 can be used, such as 64 columns 170. In some implementations, each column 170 can have 32 nozzles 180.

Groups of rows can form bands, and FIG. 2B shows an implementation with four bands 201, 202, 203, 204. The first row 281 and the second row 282 are in the first band 201, the third row 283 and the fourth row 284 are in the second band 202, the fifth row 285 and the sixth row 286 are in the third band 203, and the seventh row 287 and the eighth row 288 are in the fourth band 204. In other implementations, bands 201, 202, 203, 204 can include a greater or lesser number of rows. For example, in implementations having 32 rows, each of the four bands 201, 202, 203, 204 can include eight rows. The bands 201, 202, 203, 204 can be contiguous.

Figure 3:
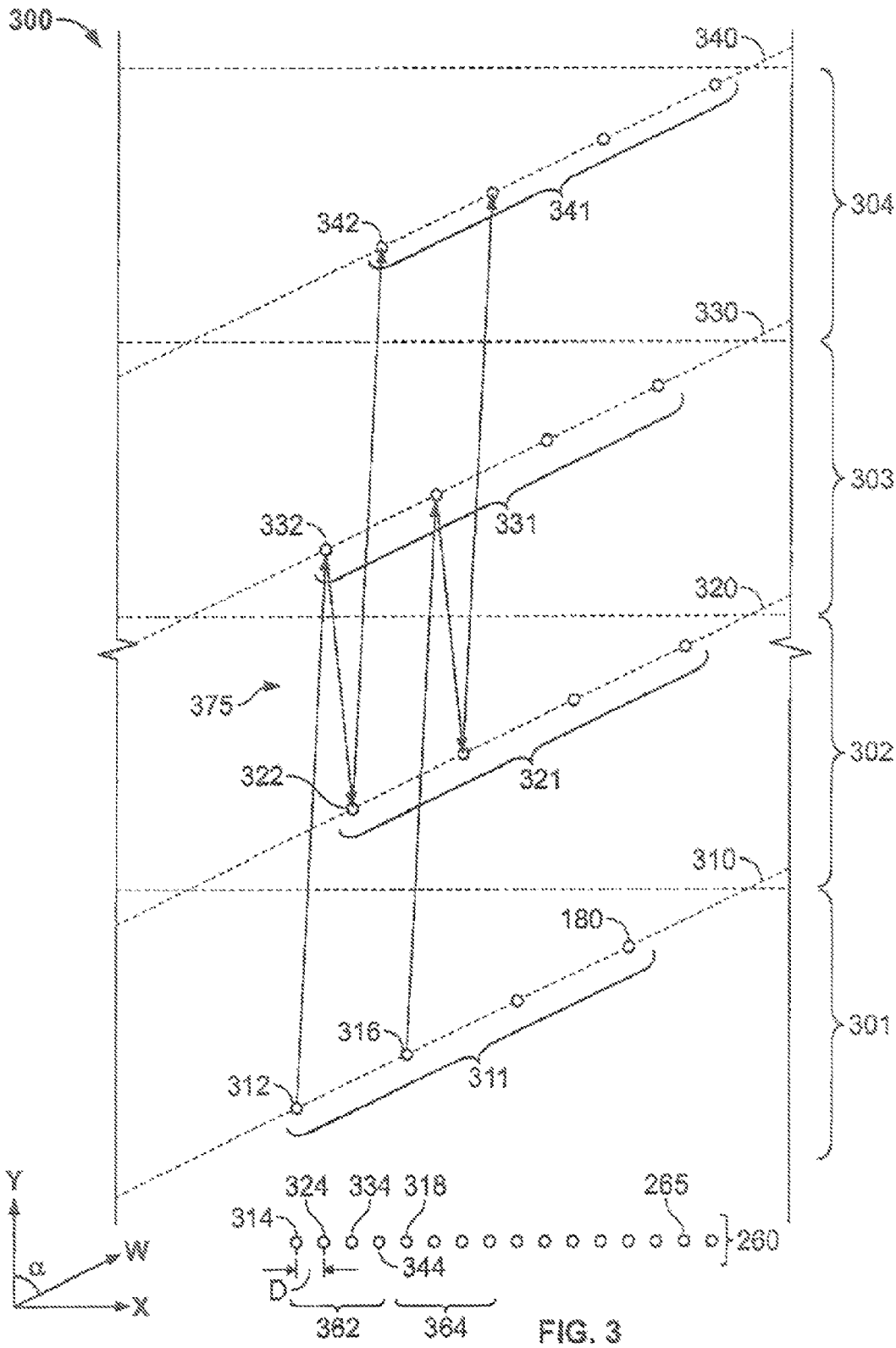
FIG. 3 is a schematic representation of a portion of an example nozzle layout.

FIG. 3 is a schematic representation of a portion of an implementation of a nozzle layout 300. This implementation includes a first band 301, a second band 302, a third band 303, and a fourth band 304. Nozzles 180 are arranged in a first column 310, a second column 320, a third column 330, and a fourth column 340. The columns 310, 320, 330, 340 are oriented in the w direction. In some implementations, the columns 310, 320, 330, 340 are parallel to an edge of the nozzle face 135. In some implementations, the rows are parallel to an edge of the nozzle face 135. FIG. 3 is expanded along the x direction for illustrative purposes, as reflected by the difference in the w direction between FIGS. 1B and 3. That is, the angle $\alpha$ represents the same angle in FIGS. 1B and 3 but appears different because FIG. 3 is expanded along the x direction. Also, the w direction appears "mirrored" since FIG. 3 represents a top-down view, as opposed to the bottom-up view represented by FIG. 1B. A first column portion 311 is in the first band 301. Similarly, a second column portion 321 is in the second band 302, a third column portion 331 is in the third band 303, and a fourth column portion 341 is in the fourth band 304.

In this implementation, the nozzles 180 in each column portion 311, 321, 331, 341 are offset such that no two nozzles 180 have a same position in the x direction. FIG. 3 illustrates only a portion of the nozzle layout 300 on the nozzle face 135 (FIG. 1B), and each column 310, 320, 330, 340 can have a column portion in each band 301, 302, 303, 304 in portions of the nozzle layout 300 not shown in FIG. 3. For example, column 310 can have four column portions, one in each of the bands 301, 302, 303, 304. Although the nozzles 180 are offset in the y direction with respect to one another, timing of ejection of the nozzles 180 can be controlled such that the nozzles 180 deposit droplets in a common position in the y direction as the sheet 140 (FIG. 1C) travels relative to the printhead 100 in the y direction, as discussed above with respect to FIG. 2A.

FIG. 3 illustrates a band pattern 375, which is illustrated as arrows between nozzles 180. In a first set of four adjacent droplets 362 deposited in a row 260 on a medium, a first droplet 314 is in a leftmost position with respect to the x direction. A second droplet 324 is adjacent and to the right of the first droplet 311. Similarly, a third droplet 334 is adjacent and to the right of the second droplet 324, and a fourth droplet 344 is adjacent and to the right of the third droplet 334. The first droplet 314 is deposited by a nozzle 312 in the first column portion 311 located in the first band 301. The second droplet 324 is deposited by a nozzle 332 in the third column portion 331 located in the third band 303. The third droplet 334 is deposited by a nozzle 322 in the second column portion 321 located in the second band 302. The fourth droplet 344 is deposited by a nozzle 342 in the fourth column portion 341 located in the fourth band 304. This implementation can be referred to as a "1-3-2-4" band pattern 375. The band pattern 375 repeats for each subsequent set of four droplets. That is, a first droplet 318 in a second set of four droplets 364 is deposited by a second nozzle 316 located in the first band 301, the second nozzle 316 being in the same column 310 as, and adjacent to, the first nozzle 312. The 1-3-2-4 band pattern is only one possible band pattern 375. Alternative band patterns 375 can include 1-2-4-3, 1-4-2-3, and 1-3-4-2. In some implementations, the nozzle layout 300 can use more than one band pattern 375. Further, in some implementations, the nozzle layout can be divided into more or less than four bands, for example, two bands, eight bands, or any integer number of bands. A controller 104 (FIG. 1C) can be configured as discussed with respect to FIG. 2A to control the timing of fluid droplet ejection to deposit droplets 265 in the row 260.

In some implementations, the band pattern 375 can be enabled by an overlapping arrangement of columns. An overlapping arrangement of columns can enable a smaller droplet pitch D than a non-overlapping arrangement, such as the arrangement illustrated in FIG. 2A. This can be because manufacturing considerations may limit a minimum achievable spacing between columns or between nozzles within columns. An overlapping arrangement of columns can permit a smaller droplet pitch D for a given minimum achievable spacing between columns. In implementations where the printhead 100 deposits droplets in more than one row 260, the overlapping arrangement of columns permits a higher droplet density. In some implementations, the droplet pitch D can be one twelve-hundredth of an inch, and a resolution of twelve hundred droplets per inch (1200 dpi) can be achieved.

Further, the use of a band pattern 375 can reduce the occurrence and/or intensity of droplet deposition inaccuracies, such as streaks. Streaks can be caused by any of a number of imperfections in an apparatus for fluid droplet ejection and deposition. For example, movement of the sheet 140 (FIG. 1C) in the x direction, which can be referred to as "web weave," may result in deposition inaccuracies because the position of the sheet 140 in the x direction may be different relative to nozzles 180 that are in different positions in the y direction. This change in position can result in droplet deposition inaccuracies in the x direction, particularly where adjacent fluid droplets (e.g., the first droplet 314 and the second droplet 324) are deposited from nozzles 180 that are in different positions in the y direction. Web weave can thus result in inaccurate deposition of fluid droplets in any nozzle layout where nozzles 180 that deposit droplets 265 in a droplet line 260 are located in different positions in the y direction relative to one another. For example, droplets 265 may be deposited on top of one another instead of adjacent to one another, resulting in an absence of fluid droplets along a line in the y direction, which may appear as a "streak." In general, the greater the distance in the y direction between nozzles 180 that deposit adjacent droplets 265, the greater the magnitude of droplet deposition inaccuracies resulting from web weave or other imperfections in the apparatus.

Therefore, it is desirable to minimize a distance in the y direction between nozzles 180 that deposit adjacent droplets on the sheet 140, and the number of bands in the band pattern 375 can be selected accordingly. In selecting the number of bands, various factors can be taken into account, such as an average spacing between columns 170, a spacing between nozzles 180 in each column 170, the number of columns 170 on the nozzle face 135, the droplet pitch D, and other factors. Any integer number of bands can be used. A four-banded nozzle layout 300 can reduce the intensity of streaks in the implementation described with respect to FIG. 3. Further, of the possible band patterns 375, band patterns can be selected to minimize the intensity of streaks or other inaccuracies for a given number of bands, such as band patterns 375 of 1-2-4-3 and 1-3-4-2 for implementations with four bands. These band patterns can reduce the intensity of inaccuracies by reducing the distance in the y direction between nozzles 180 that deposit adjacent droplets on the medium.

Figure 4:
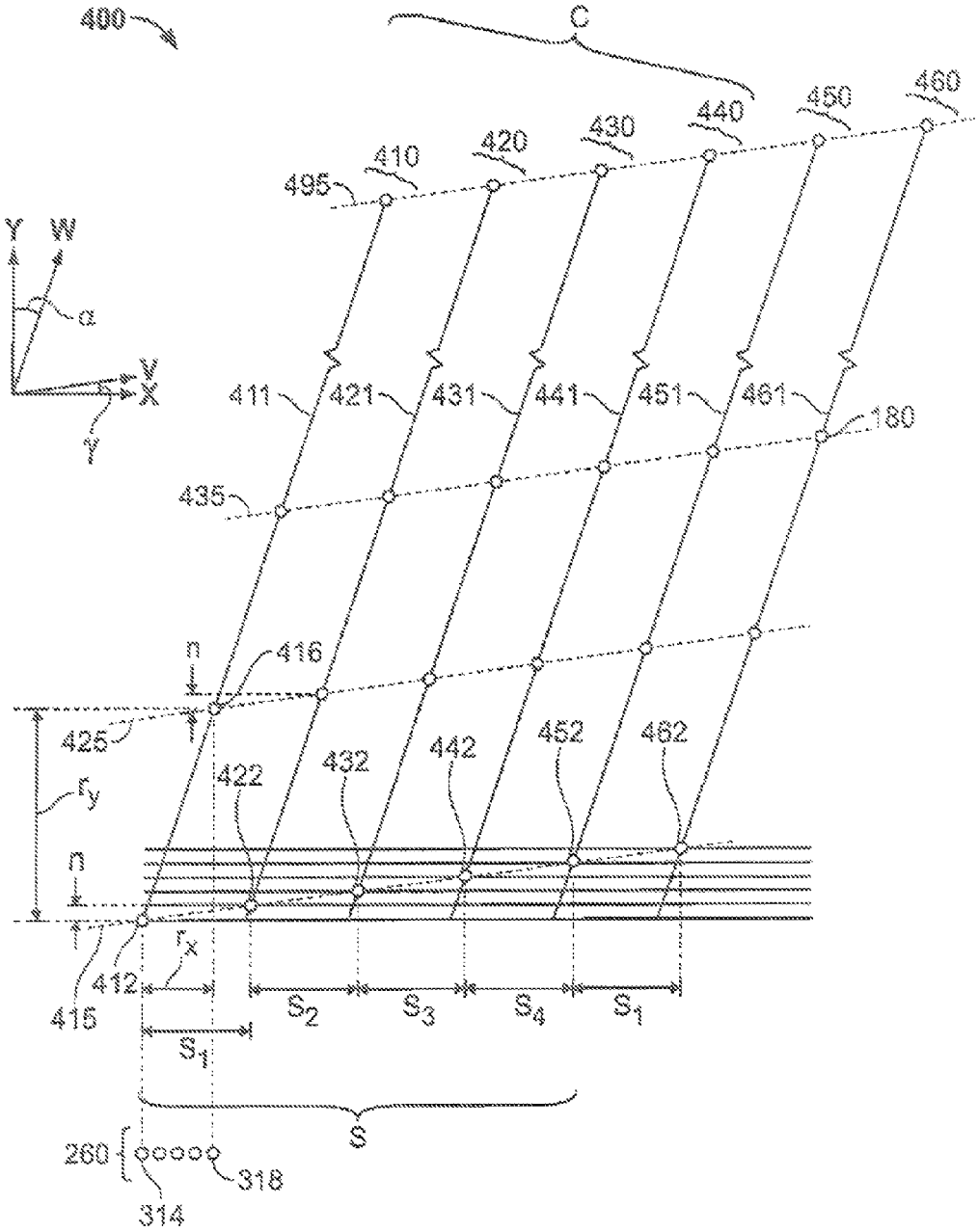
FIG. 4 is a schematic representation of portions of an example nozzle layout.

FIG. 4 is a schematic representation of a portion of an implementation of a nozzle layout 400. For illustrative purposes, this diagram is not drawn to scale. In this implementation, the nozzle layout 400 includes 64 columns with 32 nozzles 180 in each column, although only a portion of the nozzle layout 400 is illustrated in FIG. 4. FIG. 4 illustrates six columns, namely a first column 410, a second column 420, a third column 430, a fourth column 440, a fifth column 450, and a sixth column 460. The bottommost nozzles 180 in each column correspond to a first row 415, and each bottommost nozzle 180 can also be referred to as a first nozzle 412, 422, 432, 442, 452, 462 of each column 410, 420, 430, 440, 450, 460. A next adjacent nozzle 180 in each column, in the w direction, corresponds to a second row 425, a third row 435, and so forth through a last row 495, which in this implementation is the thirty-second row. The first nozzle 412 and the second nozzle 416 of the first column 410 are separated in the x direction and the y direction by a nozzle x pitch $r_x$ and a nozzle y pitch $r_y$, respectively. In this illustration, the columns 410, 420, 430, 440, 450, 460 are shown closer together, for illustrative purposes, than would be proper scale with respect to the nozzle x pitch $r_x$ and the nozzle y pitch $r_y$.

In this implementation, all of the nozzles 180 are positioned along, e.g., on, straight lines 411, 421, 431, 441, 451, 461 corresponding to each column 410, 420, 430, 440, 450, 460. The first nozzle 422 of the second column 420 is offset in the y direction by an offset n relative to the first nozzle 412 of the first column 410. The offset n can, in some implementations, be equal to the droplet pitch D. Similarly, the first nozzle 432 of the third column 430 is offset in the y direction by a distance n relative to the first nozzle 422 of the second column 420, and so on for the fourth column 440, the fifth column 450, the sixth column 460, and remaining columns in this nozzle layout 400. In this implementation, the nozzle x pitch $r_x$ can be about four times the offset n, and $r_y$ can be about 14 times the offset n.

In some implementations, the columns 410, 420, 430, 440, 450, 460 are unequally spaced. A first spacing $S_1$ is between the first column 410 and the second column 420. Similarly, a second spacing $S_2$, a third spacing $S_3$, and a fourth spacing $S_4$ are between the second column 420 and the third column 430, the third column 430 and the fourth column 440, and the fourth column 440 and the fifth column 450, respectively. That is, the spacings $S_1$, $S_2$, $S_3$, $S_4$ are measured between a column in a set of four columns C and a next adjacent column. The next adjacent column is considered in a same direction relative to each column in the set of four columns C, such as to the right of each column in the set of four columns C. The spacings $S_1$, $S_2$, $S_3$, $S_4$ form a column spacing pattern S that repeats every fifth column. That is, where the nozzle layout 400 is divided into sets of four adjacent columns C, the spacings $S_1$, $S_2$, $S_3$, $S_4$ are the same for each set of four adjacent columns C, such as a next adjacent set of four columns C to the right of the set of four columns C shown in FIG. 4. For example, a spacing between the fifth column 450 and the sixth column 460 is equal to the first spacing $S_1$. A spacing between the sixth column and a seventh column (not shown) is equal to the second spacing $S_2$, and so on for a set of four adjacent columns C that includes the fifth through eighth columns (not shown). The spacing pattern S repeats again where, for example, a spacing between a ninth column (not shown) and a tenth column (not shown) is equal to the first spacing $S_1$. The spacing pattern S repeats for sets of four adjacent columns C through a last column (not shown) in the nozzle layout 400, which in this implementation is the sixty-fourth column.

In this implementation, none of the spacings $S_1$, $S_2$, $S_3$, $S_4$ is equal to any other of the spacings $S_1$, $S_2$, $S_3$, $S_4$. In some implementations, the spacings $S_1$, $S_2$, $S_3$, $S_4$, as expressed in terms of the number of rows in the nozzle layout 400, r, and the droplet pitch, D, can be (r+1)D, (r+2)D, (r−1)D, and (r−2)D, respectively. In the implementation shown in FIG. 4, the spacings $S_1$, $S_2$, $S_3$, $S_4$ can be 33 D, 34 D, 31 D, and 30 D, respectively. Unequal column spacing permits the nozzles 180 in each column 410, 420, 430, 440, 450, 460 to be positioned on straight lines 411, 421, 431, 441, 451, 461 rather than staggered. In some implementations, one or both of the offset n and the droplet pitch D can be about one twelve-hundredth of an inch.

In some alternative implementations, some of the spacings $S_1$, $S_2$, $S_3$, $S_4$ can be equal to one another. In some implementations, the first spacing $S_1$ can be equal to the third spacing $S_3$, and the second spacing $S_2$ can be equal to the fourth spacing $S_4$. For example, for a droplet pitch D, the first spacing $S_1$ and the third spacing $S_3$ can be 30 D, and the second spacing $S_2$ and the fourth spacing $S_4$ can be 34 D. In some of these alternative implementations, the offset n between columns, described above, can be zero for adjacent columns within a pair of columns and non-zero for adjacent pairs of columns. For example, the offset n can be equal to two droplet pitches D. That is, a second pair of columns can be offset a distance 2 D in the y direction relative to a first pair of columns, and each subsequent pair of columns can be offset by the distance 2 D in the same direction.

Figure 5:
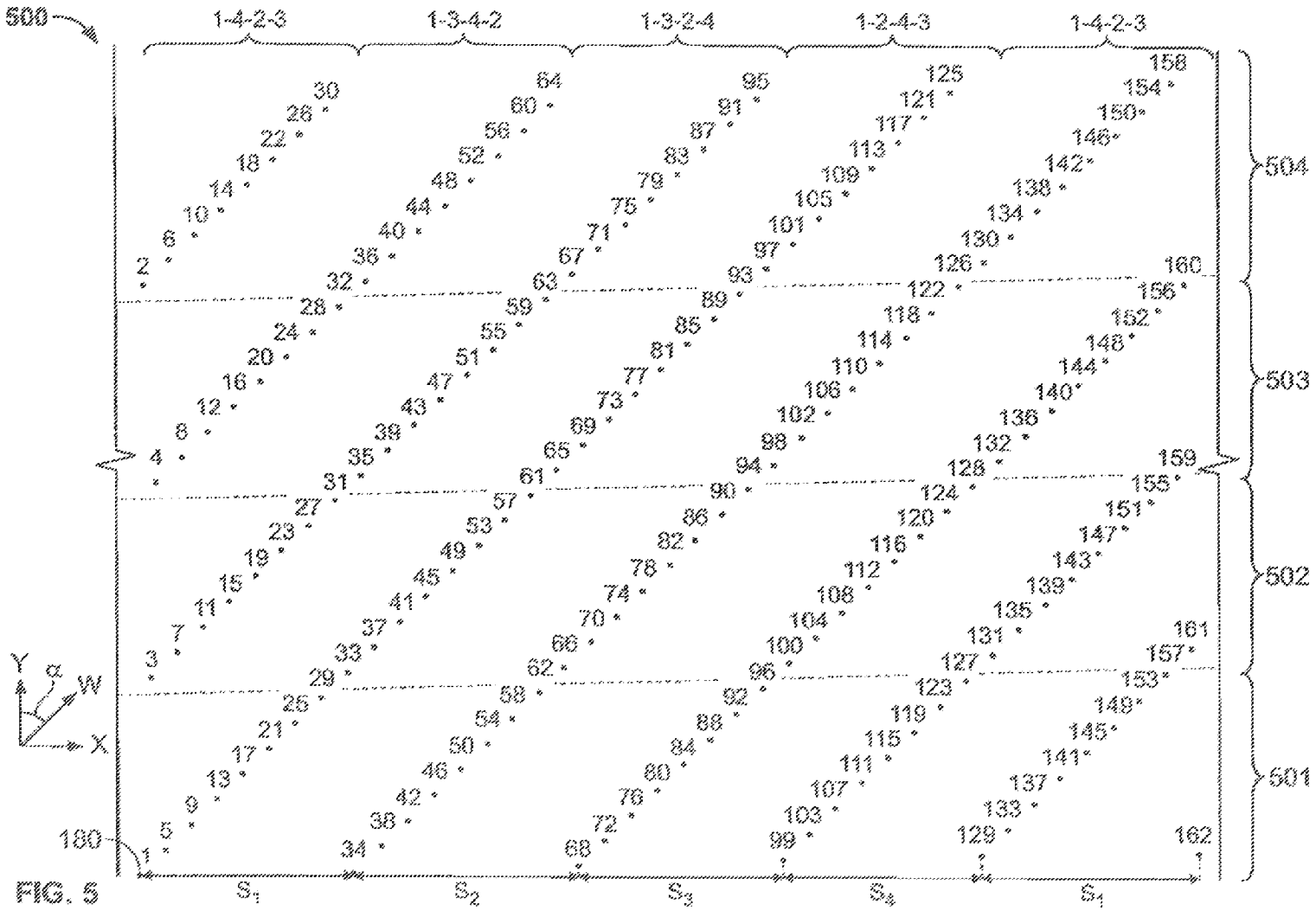
FIG. 5 is a schematic representation of a portion of an example nozzle layout.

FIG. 5 is a schematic representation of a portion of a nozzle layout 500. The schematic has been expanded along the x direction for illustrative purposes, as reflected by the enlarged angle α between the w direction and the y direction, as compared to FIG. 1B. The nozzles 180 are numbered according to position in the x direction. That is, the leftmost nozzle 180 is numbered with a "1," the next adjacent nozzle 180 is numbered with a "2," and so on. The nozzle layout 500 has a first band 501, a second band 502, a third band 503, and a fourth band 504. The bands 501, 502, 503, 504 can be contiguous. Columns extend in the w direction. Each column has 32 nozzles 180, and each column has 8 nozzles 180 in each of the bands 501, 502, 503, 504. The nozzles are arranged in four different band patterns. These band patterns are, as shown in FIG. 5 from left to right, 1-4-2-3, 1-3-4-2, 1-3-2-4, and 1-2-4-3. The following discussion of FIG. 5 considers the nozzles 180 from left to right and does not describe the temporal order in which fluid droplets are ejected from the nozzles 180.

The band pattern shown leftmost in FIG. 5 is the 1-4-2-3 band pattern. The leftmost nozzle 180 in the x direction is labeled with a "1" and is in the first band 501. The next adjacent nozzles 180 in the x direction are labeled with a "2," a "3," and a "4" and are in the fourth band 504, the second band 502, and the third band 503, respectively. The next nozzle 180 in the x direction is labeled "5" and is again in the first band 501. The 1-4-2-3 band pattern repeats until reaching the nozzle 180 labeled "32."

The nozzle layout 500 then transitions to the 1-3-4-2 band pattern. The nozzle 180 labeled "33" is in the second band 502, so this transition does not conform strictly to either the 1-4-2-3 band pattern or the 1-3-4-2 band pattern. But starting with the nozzle 180 labeled "34," the nozzle layout 500 conforms with the 1-3-4-2 band pattern. For example, the nozzles 180 labeled "34," "35," "36," and "37" are in the first band 501, third band 503, fourth band 504, and second band 502, respectively.

The nozzle layout 500 transitions to the 1-3-2-4 band pattern after the nozzle 180 labeled "64." Although the nozzles 180 labeled "65" and "66" do not adhere strictly to the 1-3-4-2 band pattern or the 1-3-2-4 band pattern, the 1-3-2-4 band pattern commences with nozzle "68." For example, the nozzles labeled "68," "69," "70," and "71" are in the first band 501, the second band 502, the fourth band 504, and the third band 503, respectively.

The nozzle layout 500 transitions to the 1-2-4-3 band pattern after the nozzle 180 labeled "95." Although the nozzles 180 labeled "96," "97," and "98" do not conform with the 1-3-2-4 band pattern or the 1-2-4-3 band pattern, the 1-2-4-3 band pattern commences with the nozzle 180 labeled 99. For example, the nozzles 180 labeled "99," "100," "101," and "102" are in the first band 501, the second band 502, the fourth band 504, and the third band 503, respectively.

The nozzle layout 500 transitions back to the 1-4-2-3 band pattern after the nozzle 180 labeled "126." Although the nozzles 180 labeled "127" and "128" do not conform to the 1-2-4-3 band pattern or the 1-4-2-3 band pattern, the 1-4-2-3 band pattern commences with the nozzle 180 labeled 129. The band patterns then repeat in the same manner described above for the remainder of the nozzle layout 500.

Figure 6A:
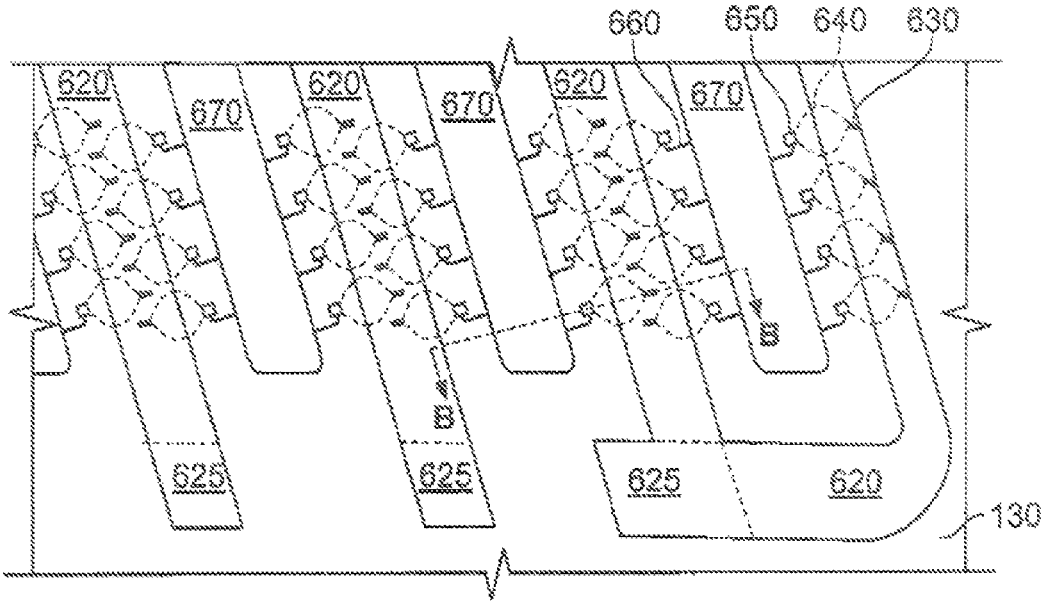
FIG. 6A is a cross-sectional view of a portion of an example substrate.

FIG. 6A is a cross sectional schematic representation of a portion of the substrate 130, which may also be referred to as part of the printhead substrate. The flow path body 605 has inlet passages 620 formed therein. The inlet passages 620 are in fluid communication with substrate inlets 625. Optionally, the flow path body 605 also has return passages 670 formed therein, and the return passages 670 are in fluid communication with substrate outlets (not shown). The flow path body 605 also includes ascenders 630, fluid pumping chambers 640, and descenders 650 formed therein. Each ascender 630 is fluidly connected to at least one of the fluid pumping chambers 640, and each fluid pumping chamber 640 is fluidly connected to at least one of the descenders 650. Optionally, a recirculation passage 660 formed in the flow path body 605 fluidly connects each descender 650 to at least one return passage 670.

Figure 6B:
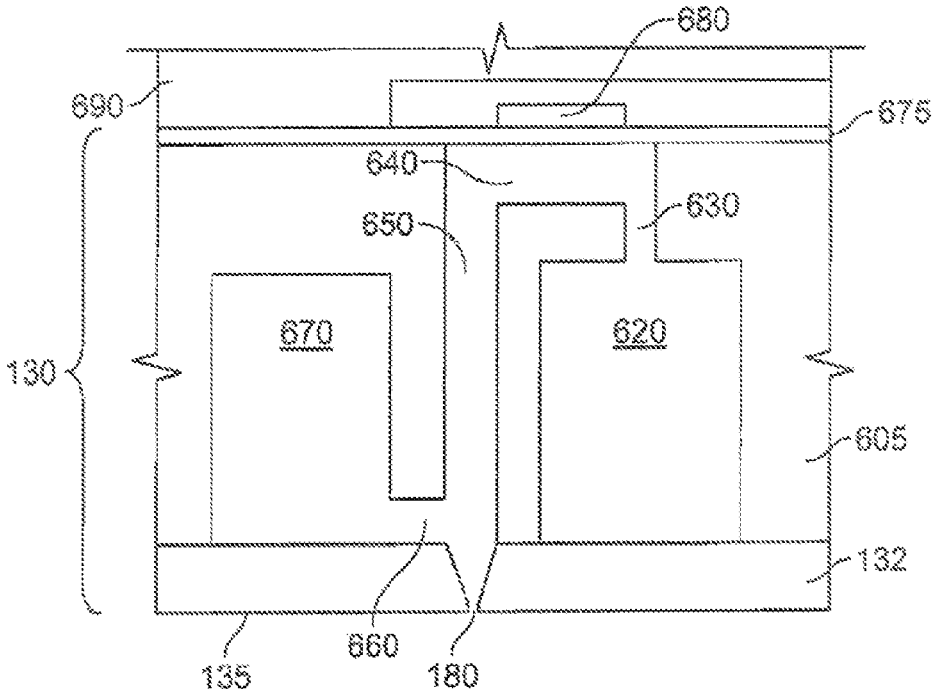
FIG. 6B is a cross-sectional schematic representation taken along line B-B in FIG. 6A.

FIG. 6B is a cross-sectional schematic representation taken along line B-B in FIG. 6A. A membrane 675 is formed on a top surface of the flow path body 605 and defines a boundary of the fluid pumping chamber 640. The transducer 680 is positioned on the membrane 675 above the fluid pumping chamber 640. An interposer 690 is also positioned on top of the membrane 675. The interposer 690 can be configured to provide fluid communication between the substrate 130 and other components of the printhead 100. The nozzle layer 132 is secured to the bottom of the flow path body 605, and the nozzle layer 132 has the nozzle 180 formed therein. The nozzle layer 132 includes the nozzle face 135. As described above, the transducer 680 can be actuated to cause ejection of a fluid droplet through the nozzle 180.

During operation, fluid flows through the substrate inlets 625 into the inlet passages 620. Fluid then flows through the ascender 630, through the fluid pumping chamber 640, and through the descender 650. From the descender 650, fluid can flow through the optional recirculation passage 660 to the return passage 670. When the transducer 680 is actuated, a pressure pulse travels down the descender 650 to the nozzle 180, and this pressure pulse can cause ejection of a fluid droplet through the nozzle 180.

Figure 7:
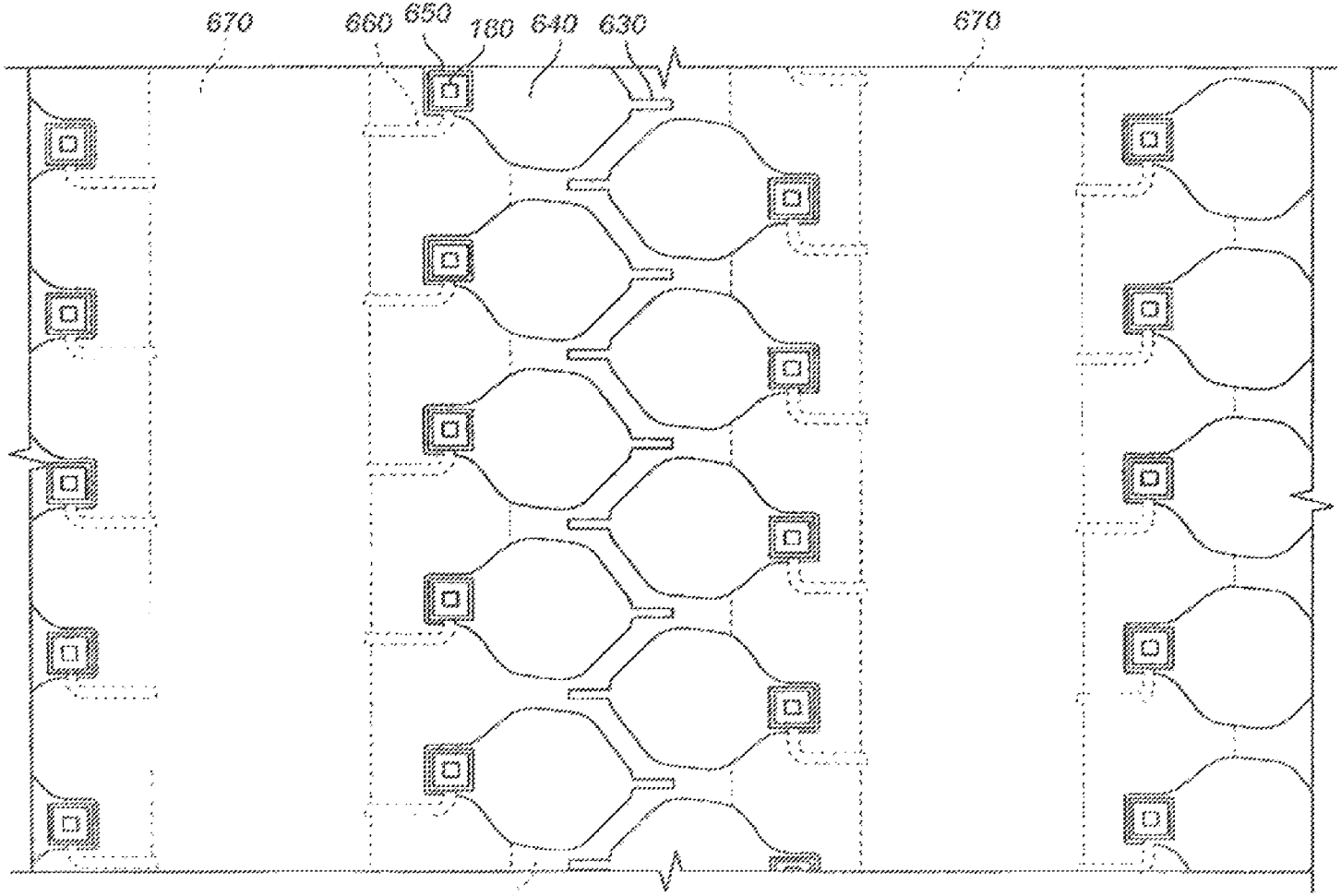
FIG. 7 is a top view schematic representation of a portion of a flow path layout of an example substrate.

FIG. 7 is a top view schematic representation of a portion of an implementation of a flow path layout of an example substrate. In some implementations, the ascender 630 can be connected to a corner or short side of the pumping chamber 640 by a short passage 632, and the descender 650 is connected or forms an opposite side of the pumping chamber 640. In some embodiments, the pumping chambers 640 is generally shaped (in horizontal cross section shown in FIG. 7) as a convex polygon, e.g., with six or more sides, e.g., with six, seven or eight sides. The corners of the pumping chamber 640 can be sharp or rounded. The descender 650 can be generally rectangular, e.g., square.

The inlets passages 620 and return passages 670 extend in parallel across the width of the substrate 130 in an alternating pattern, e.g., each pair of adjacent inlet passages separated by a return passage and each pair of return passages separated by an inlet passage. The nozzles 650 are disposed in columns parallel to the inlet passages 620 and return passages 670, with each nozzle in a single column connected by an associated flow path portion, e.g., descender, pumping chamber and ascender, to a common inlet passage 620, and each nozzle in a single column also connected by the associated flow path portion, e.g., recirculation passage 660, to a common return passage 670.

Any two adjacent columns of nozzles are connected to the inlet 625 or the same recirculation passage 660, but not both. For example, as shown in FIG. 7, the nozzles in adjacent columns A and B are connected to common inlet passage 620, but are connected to the return passages 670*a* and 670*b* on opposite sides of the common inlet passage. Similarly, the nozzles in adjacent columns B and C are connected to common return passage 670*b*, but are connected to the inlet passages (only one inlet passage is clearly visible) on opposite sides of the return passage 670*b*.

The pumping chambers 640 can also be arranged in columns, with pumping chambers that are connected to a common inlet passage positioned in two proximate columns extending parallel to the inlet passages, e.g., these two columns are closer to each other than to a column of pumping chambers connected to a different inlet passage. For a generally hexagonal pumping chamber 640, two opposing edges 642*a*, 642*b* can be generally adjacent the edges of pumping chambers from the same column. The edges 644*a*, 644*b* further form the descender 650 can be generally adjacent the edges of two pumping chambers from the proximate column. Thus, the pumping chambers of the two proximate columns are staggered, e.g., with a half-pitch step difference. The passage 632 from each pumping chamber 640 can extend partially between the adjacent pumping chambers of the proximate column.

To achieve a printer resolution of greater than 600 dpi, such as 1200 dpi or greater, there can be between 550 and 60,000 pumping chambers 640 and associated nozzles 180. For example, there can be 2,048 pumping chambers 640 in an area of less than one square inch if the pumping chambers are sized to eject fluid droplets of 2 pL. As another example, there can be about 60,000 pumping chambers in an area of less than one square inch if the pumping chambers are sized to eject fluid droplets of 0.01 pL. The area containing the pumping chambers can have a length greater than one inch, e.g., about 44 mm in length, and a width less than one inch, e.g., about 9 mm in width.

Two factors contribute to achieving a very high density of pumping chambers (and thus of nozzles). First, the pumping chambers are etched in silicon and thus can be formed by semiconductor processing techniques with small feature size at high accuracy. Second, the generally hexagonal shape of the pumping chambers permits the chambers to be closely packed in the staggered pattern.

The use of terminology such as "front," "back," "top," "bottom," "above," and "below" throughout the specification and claims is for illustrative purposes only, to distinguish between various components of the system, printhead, substrate, and other elements described herein. The use of such terminology does not imply a particular orientation of the printhead, the substrate, or any other components. Similarly the use of horizontal and vertical to describe elements is in relation to the implementation described. In other implementations, the same or similar elements can be oriented other than horizontally or vertically as the case may be.

The controller and its functional operations can be implemented in digital electronic circuitry, or in computer software, firmware, or hardware, or in combinations of them. In particular, the functional operations can be implemented with one or more computer program products, i.e., one or more computer programs tangibly embodied in an information carrier, e.g., in a machine readable storage device, for execution by, or to control the operation of, data processing apparatus, e.g., a programmable processor, a computer, or multiple processors or computers.

A number of embodiments of the invention have been described. Nevertheless, it will be understood that various modifications may be made without departing from the spirit and scope of the invention. For example, the nozzle layout can be configured such that the offset between the first nozzles in adjacent columns can be zero for a first pairs of columns and non-zero for an adjacent pair of columns. All, some, or none of the spacings in the spacing pattern can be equal to another spacing in the spacing pattern. A nozzle layout may include more than one column spacing pattern. A column spacing pattern can include fewer than four columns or more than four columns. Accordingly, other embodiments are within the scope of the following claims.

What is claimed is:

1. A fluid ejection apparatus, comprising:

a nozzle layer having a nozzle face, the nozzle face having a length direction along a long edge of the nozzle face and a width direction along a short edge of the nozzle face;

nozzles arranged in columns, each column of nozzles oriented in a column direction substantially parallel with other columns of nozzles, the nozzles being configured to deposit droplets onto a medium that is in a relative motion with respect to the apparatus along a motion direction perpendicular to a width direction of the medium; and a first pair of directly adjacent columns and a second pair of directly adjacent columns, the first pair and the second pair being directly adjacent to each other, the nozzles of different columns of the first pair of directly adjacent columns having an offset equal to zero along the motion direction, any of the nozzles of the first pair of directly adjacent columns having a non-zero offset along the motion direction from any of the nozzles of the second pair of directly adjacent columns.

2. The apparatus of claim 1, wherein spacing between the directly adjacent columns is equal.

3. The apparatus of claim 1, wherein the column direction is at an oblique angle relative to both the motion direction and the width direction of the medium.

4. The apparatus of claim 1, wherein the nozzle layer has a short edge substantially parallel to the column direction, the nozzles in different columns are arranged in rows along a row direction and the nozzle layer has a long edge substantially parallel to the row direction.

* * * * *